US010337229B2

(12) United States Patent
Beattie

(10) Patent No.: US 10,337,229 B2
(45) Date of Patent: Jul. 2, 2019

(54) HINGE

(71) Applicant: Kohler Mira Limited, Gloucestershire (GB)

(72) Inventor: Colin Beattie, Gloucestershire (GB)

(73) Assignee: KOHLER MIRA LIMITED (GB)

( * ) Notice: Subject to any disclaimer, the term of this patent is extended or adjusted under 35 U.S.C. 154(b) by 0 days.

(21) Appl. No.: 15/548,056

(22) PCT Filed: Feb. 3, 2016

(86) PCT No.: PCT/GB2016/050246

§ 371 (c)(1),
(2) Date: Aug. 1, 2017

(87) PCT Pub. No.: WO2016/124919

PCT Pub. Date: Aug. 11, 2016

(65) Prior Publication Data

US 2018/0010376 A1 Jan. 11, 2018

(30) Foreign Application Priority Data

Feb. 4, 2015 (GB) ..... 1501869

(51) Int. Cl.

| | |
|---|---|
| ***E05D 11/10*** | (2006.01) |
| ***E05F 3/20*** | (2006.01) |
| ***E05F 3/10*** | (2006.01) |
| ***E05D 3/02*** | (2006.01) |
| ***E05D 7/04*** | (2006.01) |

(Continued)

(52) U.S. Cl.

CPC ..... *E05F 3/104* (2013.01); *E05D 3/02* (2013.01); *E05D 7/04* (2013.01); *E05D 11/00* (2013.01);

(Continued)

(58) Field of Classification Search

CPC ..... E05D 7/04; E05D 11/10; E05D 11/1064; E05D 11/1078; E05D 11/1028;

(Continued)

(56) References Cited

U.S. PATENT DOCUMENTS 5,867,869 A * 2/1999 Garrett ..... A47K 3/36 16/252
6,766,561 B1 * 7/2004 Cheng ..... E05D 5/0246 16/235

(Continued)

FOREIGN PATENT DOCUMENTS

DE 202008010722 10/2008
DE 202009004855 10/2010

(Continued)

OTHER PUBLICATIONS

International Search Report and Written Opinion regarding Application No. PCT/GB2016/050246 dated May 3, 2016 (9 pages).

*Primary Examiner* — Emily M Morgan

(74) *Attorney, Agent, or Firm* — Foley & Lardner LLP

(57) ABSTRACT

A hinge having a first hinge part and a second hinge part. The second hinge part has a hinge pin to which the first hinge part is connected for movement relative to the second hinge part about a hinge axis between a closed position. An over-close mechanism is provided comprising a catch member on the second hinge part arranged to co-operate with the first hinge part to urge the first hinge part towards the closed position during closing movement of the first hinge part and to retain the first hinge part arrange to co-operate with the hinge pin to urge the first hinge part towards the closed position during closing movement. A soft-close mechanism is provided comprising a damper member on the first hinge part arranged to co-operate with the hinge pin to provide a braking force in the direction of closing.

16 Claims, 10 Drawing Sheets

(51) Int. Cl.
*E05D 11/00* (2006.01)
*E05F 3/22* (2006.01)
*E05D 5/02* (2006.01)

(52) U.S. Cl.
CPC ..... *E05D 11/105* (2013.01); *E05D 11/1014* (2013.01); *E05D 11/1064* (2013.01); *E05F 3/20* (2013.01); *E05F 3/22* (2013.01); *E05D 5/0246* (2013.01); *E05D 11/0054* (2013.01); *E05D 2007/0469* (2013.01); *E05Y 2201/11* (2013.01); *E05Y 2201/21* (2013.01); *E05Y 2201/218* (2013.01); *E05Y 2800/672* (2013.01); *E05Y 2900/114* (2013.01)

(58) Field of Classification Search
CPC ..... E05D 11/105; E05F 3/10; E05F 3/104; E05F 3/20; E05F 3/22
See application file for complete search history.

(56) References Cited

U.S. PATENT DOCUMENTS 7,917,994 B2 * 4/2011 Bai ..... E05D 11/105 16/252
8,046,873 B2 * 11/2011 Chang ..... E05D 5/0246 16/252
9,695,621 B2 * 7/2017 Walhorn ..... E05F 1/1253
2005/0125949 A1 * 6/2005 Lin ..... E05D 5/0246 16/248
2009/0106937 A1 * 4/2009 Bai ..... E05D 11/105 16/252
2009/0119877 A1 * 5/2009 Garrett ..... E05D 11/00 16/319
2010/0275409 A1 * 11/2010 Walhorn ..... E05D 5/0246 16/235
2012/0117755 A1 * 5/2012 Walhorn ..... E05F 3/104 16/66
2012/0117758 A1 * 5/2012 Walhorn ..... E05F 1/1253 16/321
2012/0216370 A1 * 8/2012 Chow ..... E05D 5/0246 16/54
2016/0160550 A1 * 6/2016 Bacchetti ..... E05D 11/105 16/319
2017/0114581 A1 * 4/2017 Jeanrot ..... E05D 3/022
2018/0298658 A1 * 10/2018 Brun ..... E05D 3/12

FOREIGN PATENT DOCUMENTS

EP 1201171 A1 * 5/2002 ..... A47K 3/30
WO WO-2012049518 A1 * 4/2012 ..... E05F 3/20

* cited by examiner

HINGE

CROSS-REFERENCE TO RELATED APPLICATIONS

This application is a U.S. National Stage application of International (PCT) Application No. PCT/GB/2016/050246, filed on Feb. 3, 2016, which claims the benefits of and priority to GB Application No. 1501869.0, filed on Feb. 4, 2015. The foregoing applications are incorporated by reference herein in their entireties.

SUMMARY

This invention relates to hinges for mounting a movable panel. More especially, but not exclusively, the invention concerns hinges for mounting shower doors. The invention may have particular application for mounting frameless shower doors made of glass.

A preferred object of the present invention is to provide an improved hinge for shower doors.

According to one aspect of the invention there is provided a hinge for mounting a movable panel such as a shower door, the hinge comprising a first hinge part for securing to a movable panel and second hinge part for securing to a fixed structure, the second hinge part having a hinge pin to which the first hinge part is connected for movement relative to the second hinge part about a hinge axis between a closed position and an open position, and at least one of an over-close mechanism, a self-close mechanism and a soft-close mechanism.

The over-close mechanism may be activated as the first hinge part approaches the closed position. The over-close mechanism may assist closing movement. The over-close mechanism may comprise a catch member on the second hinge part arranged to co-operate with the first hinge part to urge the first hinge part towards the closed position during closing movement of the first hinge part and to retain the first hinge part in the closed position. The catch member may be biased to engage the first hinge part. The catch member may be biased by a spring. The biasing force may be adjustable.

The self-close mechanism may be activated during movement of the first hinge part from the open position to the closed position. The self-close mechanism may assist closing movement. The self-close mechanism may comprise a pressure member on the first hinge part arranged to co-operate with the hinge pin to urge the first hinge part towards the closed position during closing movement. The pressure member may be biased to engage the hinge pin. The pressure member may be biased by a spring. The biasing force may be adjustable. The pressure member may engage a cam portion of the hinge pin. The cam portion may have cam faces engaged by the pressure member to hold the first hinge part in the open and closed positions. When both the over-close and self-close mechanism are provided, the self-close mechanism may be activated before the over-close mechanism in the direction of closing.

The soft-close mechanism may be activated during movement of the first hinge part from the open position to the closed position. The soft-close mechanism may resist closing movement. The soft-close mechanism may comprise a damper member on the first hinge part arranged to co-operate with the hinge pin to provide a braking force in the direction of closing. The damper member may be biased to engage the hinge pin. The damper member may be biased to engage a cam portion of the hinge pin. The damper member may be biased by a damper. The damper may comprise a damping fluid responsive to displacement of the damper member by the hinge pin to apply a damping force to brake closing movement of the first hinge part. When both the self-close mechanism and soft-close mechanism are provided, the self-close mechanism may be activated before the soft-close mechanism in the direction of closing. When both the soft-close mechanism and over-close mechanism are provided, the soft-close mechanism may be activated before the over-close mechanism in the direction of closing.

In some embodiments, at least one of the first and second hinge parts may have an adjustment mechanism for height adjustment of a movable panel mounted by the hinge. The height adjustment mechanism may comprise at least one eccentric washer that is rotatable to adjust the height of a movable panel mounted by the hinge.

According to another aspect of the invention there is provided a hinge for mounting a movable panel such as a shower door, the hinge comprising a first hinge part for securing to a movable panel and second hinge part for securing to a fixed structure, the first hinge part being connected for movement relative to the second hinge part about a hinge axis between a closed position and an open position, wherein at least one of the first and second hinge parts has an adjustment mechanism for height adjustment of a movable panel mounted by the hinge.

The height adjustment mechanism may comprise at least one eccentric washer that is rotatable to adjust the height of a movable panel mounted by the hinge.

The hinge may include one or more of an over-close mechanism, a self-close mechanism and a soft-close mechanism. Where provided, the over-close mechanism, self-close mechanism and soft-close mechanism may be in accordance with the preceding aspect of the invention.

The invention will now be described in more detail by way of example with reference to the accompanying drawings wherein:

DETAILED DESCRIPTION

Figure 18:
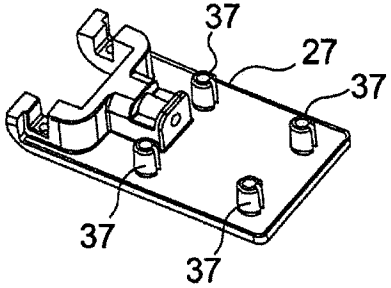
FIGS. 18 and 19 show modifications of the hinge.
Figure 19:
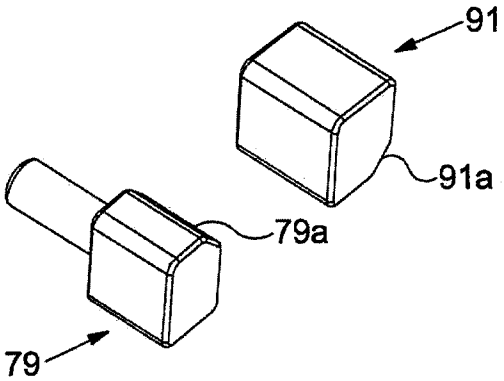

Referring to the accompanying drawings, an embodiment of a hinge 1 according to the invention is shown in FIGS. 1 to 4 and operation of the hinge 1 is shown in FIGS. 5 through 17. Modifications of the hinge 1 are shown in FIGS. 18 and 19.

The hinge 1 shown in FIGS. 1 to 4 may be employed for connecting a movable panel (not shown) to a fixed panel (not shown) or a wall or similar fixed structure. The movable panel may be made of glass. The movable panel may be frameless. The movable panel may be a shower door. Where provided the fixed panel may be made of a glass. The fixed panel may be frameless. The fixed panel may be a wall or screen of a shower enclosure.

The hinge 1 has a first hinge part 3 that, is use, is secured to the movable panel and a second hinge part 5 that, in use, is secured to the fixed panel or wall or similar fixed structure. The hinge parts 3, 5 are connected by a hinge pin 7 that defines a hinge axis for opening and closing movement of the movable panel relative to the fixed panel.

The first hinge part 3 has a base plate 9 and a clamp plate 11 releasably secured to the base plate 9 to secure the movable panel therebetween. Gaskets 13, 15 may be provided between the movable panel and the plates 9, 11.

In this embodiment the plates 9, 11 are secured by four screws 17 passing through the clamp plate 11 and received in threaded bores of bosses 19 on the base plate 9. In other embodiments more than or less than four screws 17 may be employed. In other embodiments the plates 9, 11 may be releasably secured by alternative means.

In this embodiment, eccentric washers 21 are located on two of the bosses 19 between the plates 9, 11. The washers 21 can be rotated during installation to adjust the height of the movable panel. In other embodiments more than or less than two eccentric washers 21 may be employed. In other embodiments the eccentric washers 21 may be omitted.

The first hinge part 3 also has a removable cover plate 23 that is releasably attached to the clamp plate 11 to conceal the clamp plate 11. In this embodiment the cover plate 23 is secured by four bushes 25. In other embodiments more than or less than four bushes 25 may be employed. In other embodiments the cover plate 23 may be releasably secured by alternative means.

The second hinge part 5 has a base plate 27 and a clamp plate 29 releasably secured to the base plate 27 to secure the fixed panel therebetween. Gaskets 31, 33 may be provided between the movable panel and the plates 27, 29.

In this embodiment the plates 27, 29 are secured by three screws 35 passing through the clamp plate 29 and received in threaded bores of bosses 37 on the base plate 27. In other embodiments more than or less than three screws 35 may be employed. FIG. 18 shows a modification in which the base plate 27 has four bosses 37 with threaded bores to receive four screws for securing the plates 27, 29. In other embodiments the plates 27, 29 may be releasably secured by alternative means.

In this embodiment, eccentric washers 39 are located on two of the bosses 37 between the plates 27, 29. The washers 39 can be rotated during installation to adjust the height of the movable panel. In other embodiments more than or less than two eccentric washers 39 may be employed. In other embodiments the eccentric washers 39 may be omitted.

The second hinge part 5 also has a removable cover plate 41 that is releasably attached to the clamp plate 29 to conceal the clamp plate 29. In this embodiment the cover plate 41 is secured by four bushes 43. In other embodiments more than or less than four bushes 43 may be employed. In other embodiments the cover plate 41 may be releasably secured by alternative means.

The first hinge part 3 has a pivot housing 45 with a sleeve 47 defining a through bore 49 through which the hinge pin 7 extends and is secured at each end to the second hinge part 5 to connect the first hinge part 3 to the second hinge part 5 for pivotal movement about the hinge axis.

In this embodiment the hinge pin 7 is secured to the second hinge part 5 by screws 50 that pass through the ends of the hinge pin 7 and are received in threaded bores 51 (one only shown in FIG. 2) on the second hinge part 5. In other embodiments the hinge pin 7 may be secured by alternative means.

In this embodiment, the ends of the hinge pin 7 are of rectangular section and are received in U-shaped seats 53 on the second hinge part 5 so as to prevent the hinge pin 7 rotating relative to the second hinge part 5. In other embodiments, alternative means may be employed to prevent the hinge pin 7 rotating relative to the second hinge part 5.

The sleeve 47 is located between the seats 53 and bushes 55 are provided on the hinge pin 7 at each end between the sleeve 47 and the seats 53 to facilitate rotation of the sleeve 47 about the hinge axis between the seats 53.

The hinge 1 further includes an over-close mechanism 57, a self-close mechanism 59, a soft-close mechanism 61.

The over-close mechanism 57 is arranged on the second hinge part 5 and co-operates with the sleeve 47 on the first hinge part 3 to assist the final closing movement and holds the hinge 1 in the closed position. In use, the over-close mechanism 57 ensures good sealing contact of the movable panel in the closed position. In this way, when the movable panel is a shower door, a watertight seal is obtained to prevent water leaking from the enclosure when the door is closed.

In this embodiment the over-close mechanism 57 comprises a ball catch that includes a spring 65 arranged to bias a housing 67 supporting a roller 69 that engages the sleeve 47, and the sleeve 47 has a groove 71 that extends lengthwise of the sleeve 47 in which the roller 69 is received in the closed position.

The housing 67 is slidably mounted in a bore 73 on the second hinge part 5 and the spring 65 acts between the housing 67 and an abutment member 75 that can be moved within the bore 73 to adjust the biasing force of the spring 65 by means of a grub screw 77.

In other embodiments the abutment member 75 and grub screw 77 for adjusting the biasing force may be omitted. In other embodiments the ball catch may be replaced by any other arrangement for co-operating with the sleeve 47.

The operation of the over-close mechanism 57 will now be described in more detail with reference to FIGS. 5 to 7.

Figure 1:
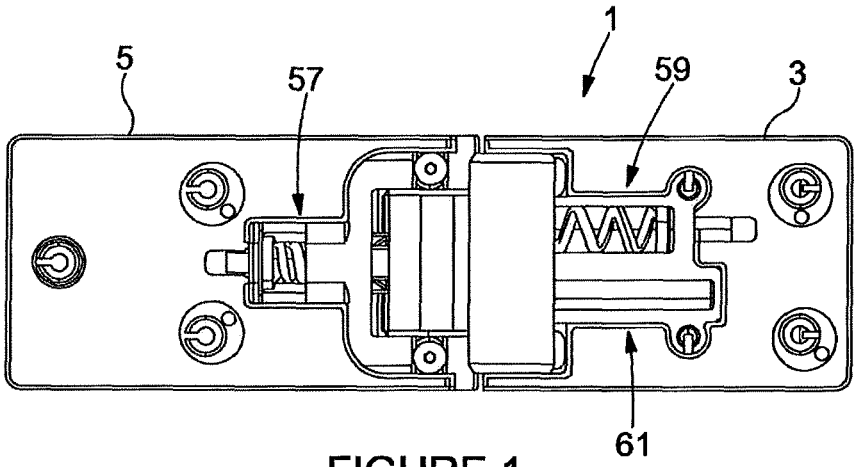
FIG. 1 is sectional view of a hinge embodying the invention.
Figure 4:
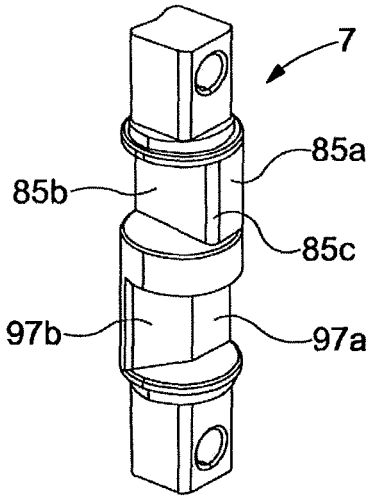
FIG. 4 is an enlarged perspective view of the hinge pin shown in FIG. 3.
Figure 2:
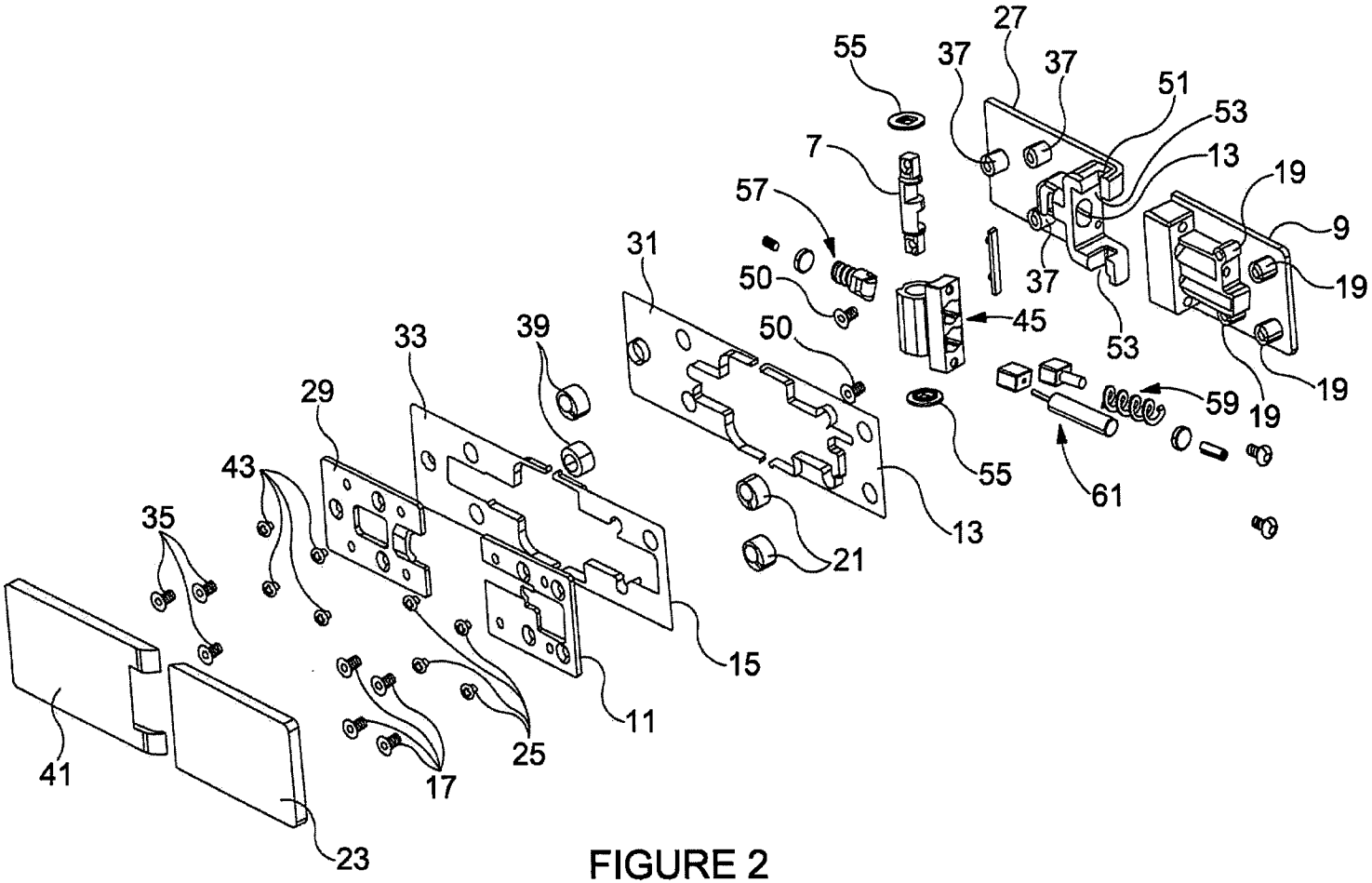
FIG. 2 is a partial exploded perspective view of the hinge shown in FIG. 1.
Figure 3:
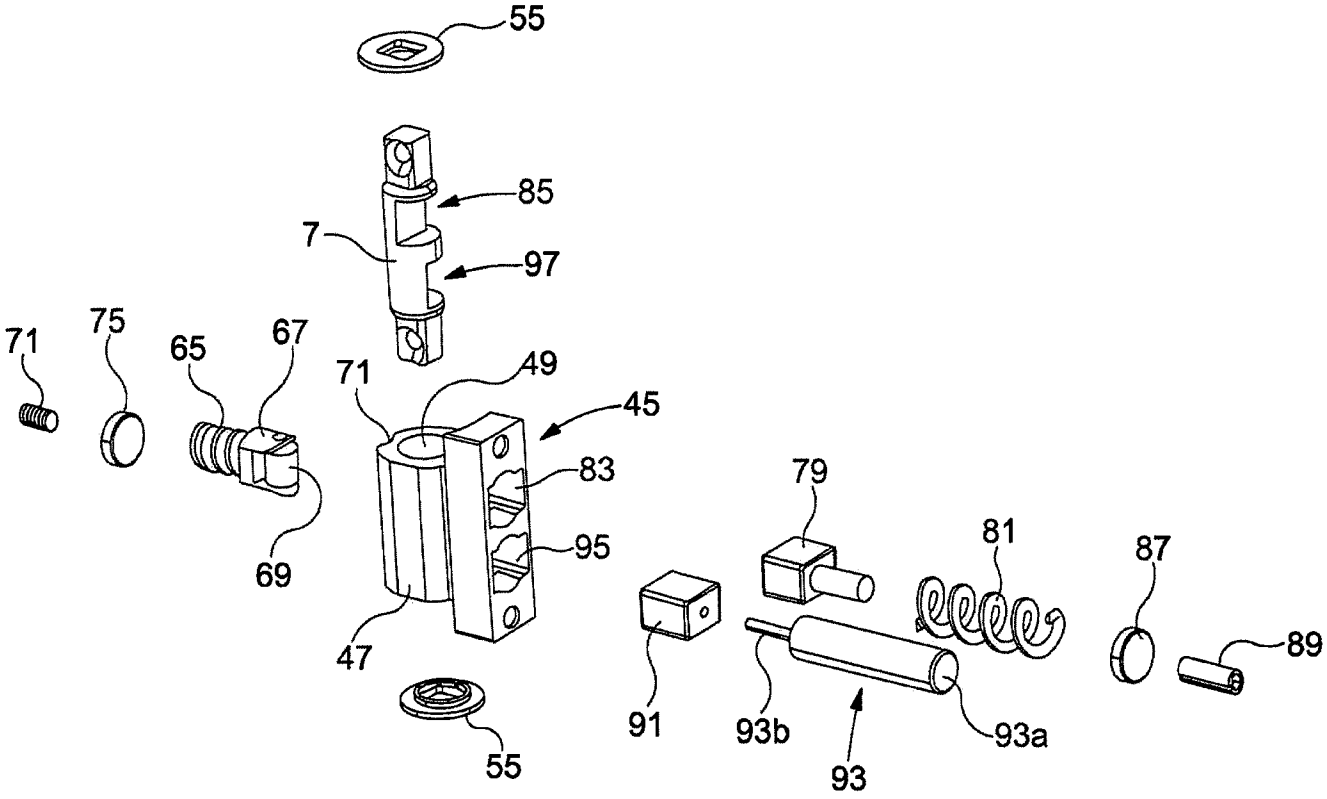
FIG. 3 is an exploded perspective view of elements of the hinge shown in FIG. 2.
Figure 5:
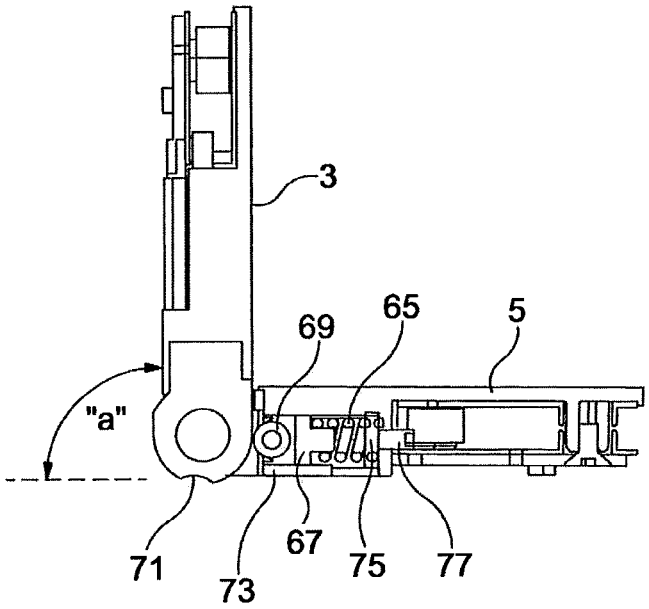
FIGS. 5, 6 and 7 are schematic views showing operation of the over-close mechanism of the hinge shown in FIG. 3.

FIG. 5 shows the hinge 1 in the open position with the first hinge part 3 extending at an angle "a" of around 90° to the second hinge part 5. In other embodiments, the open position may correspond to an angle more than or less than 90°.

In the open position the roller 69 engages the outer surface of the sleeve 47 under the biasing of the spring 65. As the hinge part 3 rotates about the hinge axis 7 towards the closed position, the roller 69 first engages a smooth arcuate portion of the outer surface of the sleeve 47 that leads to the groove 71 in the outer surface of the sleeve 47.

Figure 6:
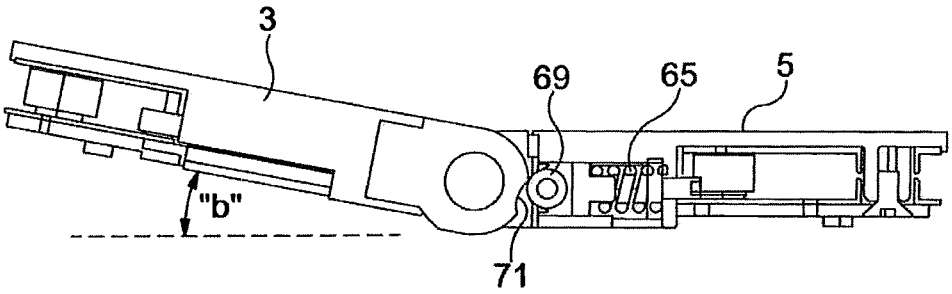
Figure 7:
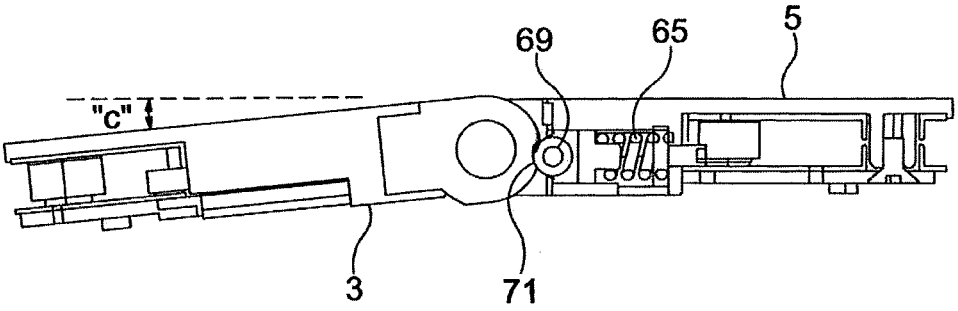

FIG. 6 shows the hinge 1 approaching the closed position where the roller 69 starts to enter the groove 71 and FIG. 7 shows the hinge 1 in the closed position with the roller 69 seated in the groove 71.

As the roller 69 enters the groove 71, the biasing of the roller 69 by the spring 71 assists closing movement of the hinge 1 and, when the hinge 1 is closed, the engagement of the roller 69 in the groove 71 holds the hinge 1 in the closed position.

The biasing force of the spring 71 controls the closing force and the sealing force and can be altered by adjusting the grub screw 77 to move the abutment member 75 towards or away from the roller housing 67. By increasing the biasing force, the closing force and the sealing force are increased so that final movement to the closed position is speeded up and seal efficiency in the closed position is improved.

In this embodiment, the over-close mechanism 57 is activated during the final part of the closing movement and, in the closed position, holds the hinge parts 3, 5 in an over-centre position so that, in use, there is force urging the movable panel closed in the closed position.

In this embodiment, the over-close mechanism 57 is activated with the first hinge part extending at an angle "b" of around 10° to the second hinge part 5 and in the closed position, the first hinge part 3 extends at an angle "c" of around −5° to the second hinge part 5.

In other embodiments, the over-close mechanism may be activated with the first hinge part 3 extending at more than or less than 10° and may hold the first hinge part at more than or less than −5°.

The self-close mechanism 59 is arranged on the first hinge part 3 and co-operates with the hinge pin 7 on the second hinge part 5 to hold the hinge 1 in the open and closed positions and assists closing movement of the hinge 1 from the open position to the closed position.

In this embodiment the self-close mechanism 59 comprises a pressure member or pad 79 and a spring 81 arranged to bias the pressure pad 79 to engage the hinge pin 7 in the open and closed positions and during movement between the open and closed positions.

The pressure pad 79 is slidably mounted in a bore 83 in the pivot housing 45 that opens to the bore 49 in the sleeve 47 and the hinge pin 7 has a cam portion 85 aligned with the bore 83. The cam portion 85 has three cam faces 85*a*, 85*b*, 85*c* that are flat and extend at an angle to each other.

The pressure pad 79 engages the cam face 85*a* in the open position and engages the cam face 85*b* in the closed position. In this embodiment the cam faces 85*a*, 85*b* extend at approximately 95° to each other corresponding to the angle between the open and closed positions of the hinge 1. The angle between the cam faces 85*a*, 85*b* may be different in other embodiments.

The spring 81 acts between the pressure pad 79 and an abutment member 87 that can be moved towards and away from the pressure pad 79 to adjust the biasing force of the spring 81 by means of a grub screw 89.

In other embodiments the abutment member 87 and grub screw 89 for adjusting the biasing force may be omitted. In other embodiments the pressure pad 79 may be replaced by any other arrangement for co-operating with the hinge pin 7. In other embodiments, the pressure pad 79 may be configured to assist assembly in the correct orientation. FIG. 19 shows a modification in which the pressure pad 79 is provided with one or more chamfers 79*a* to prevent the pressure pad 79 being inserted in the bore in the wrong orientation.

The operation of the self-close mechanism 59 will now be described in more detail with reference to FIGS. 8 to 11.

Figure 8:
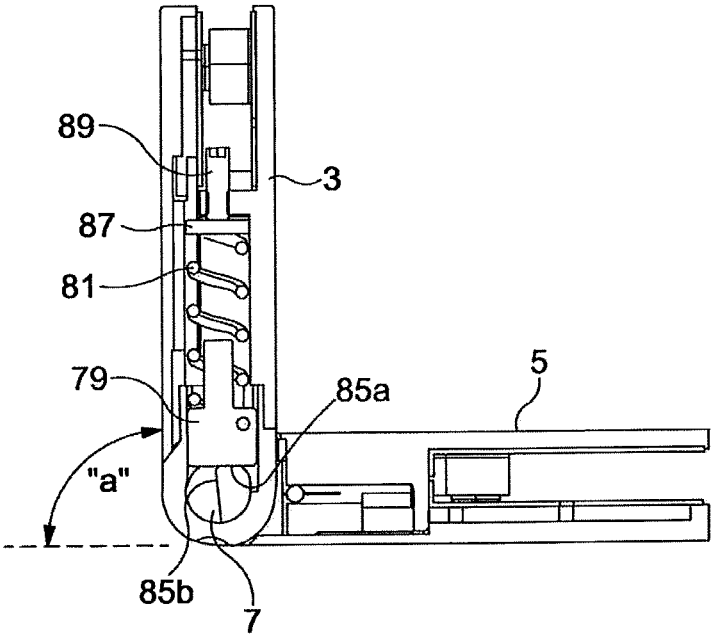
FIGS. 8, 9, 10 and 11 are schematic views showing operation of the self-close mechanism of the hinge shown in FIG. 3.

FIG. 8 shows the hinge 1 in the open position with the first hinge part 3 extending at an angle "a" of around 90° to the second hinge part 5. In other embodiments, the open position may correspond to an angle more than or less than 90°.

In the open position the pressure pad 79 engages the flat cam face 85*a* under the biasing of the spring 81. As the hinge part 3 rotates about the hinge axis towards the closed position, the pressure pad 79 engages the cam face 85*c* that connects the cam faces 85*a* and 85*b* to activate the self-closing action to assist movement of the hinge 1 to the closed position in which the pressure pad 79 engages the cam face 85*b*.

Figure 9:
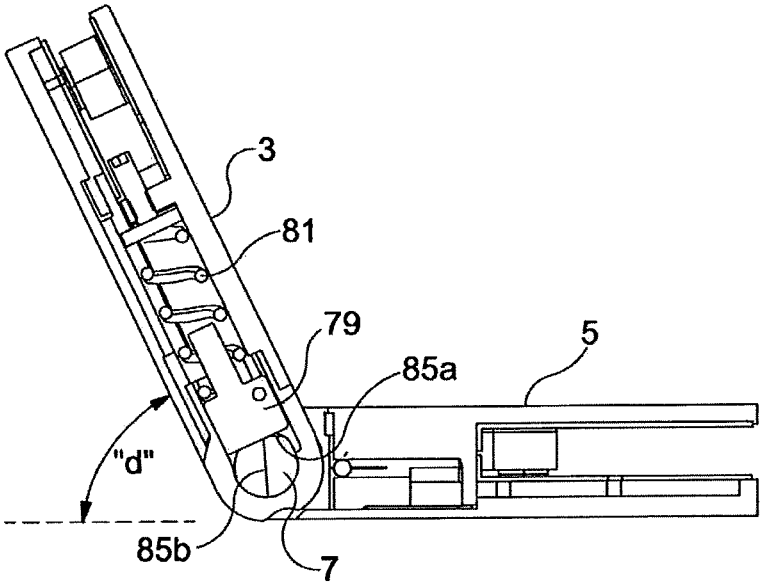
Figure 10:
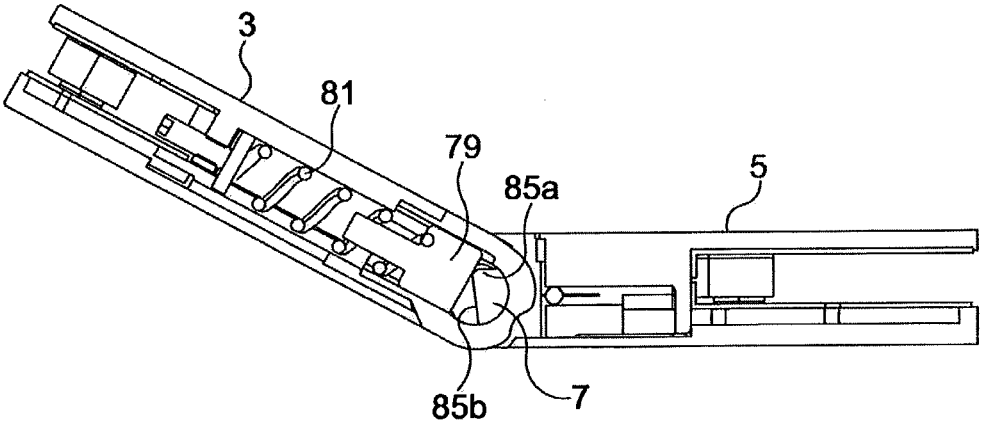
Figure 11:
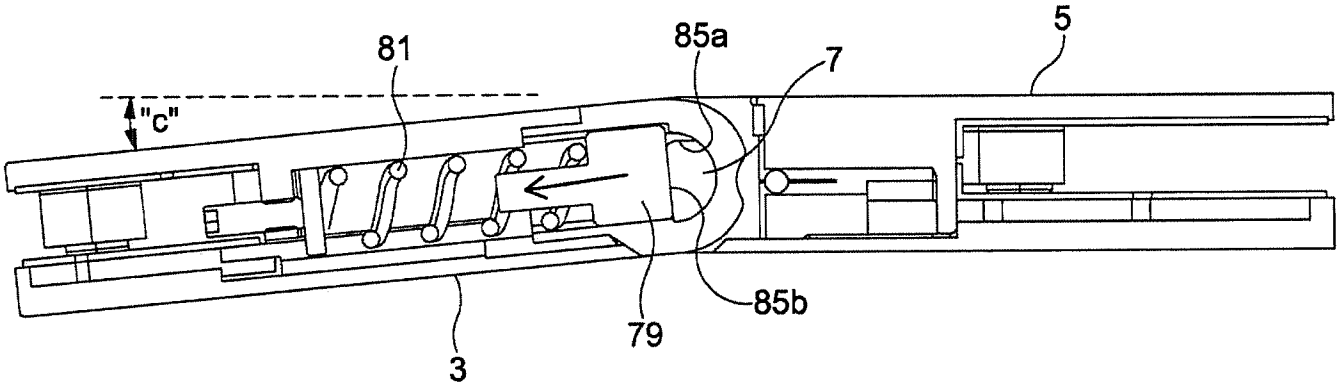

FIG. 9 shows the hinge 1 in an intermediate position at the start of the self-closing action. FIG. 10 shows the hinge 1 in a further intermediate position and FIG. 11 shows the hinge 1 in the closed position.

The biasing force of the spring 81 controls the closing force and can be altered by adjusting the grub screw 89 to move the abutment member 87 towards or away from the roller housing pressure pad 79. By increasing the biasing force, the closing force is increased so that movement to the closed position is speeded up.

The self-close mechanism 59 is activated when the engagement between the pressure pad 79 and the hinge pin 7 passes through an over-centre position urging rotation of the first hinge part 3 towards the closed position.

In this embodiment, the self-close mechanism 59 is activated with the first hinge part extending at an angle "d" of around 65° to the second hinge part 5. In other embodiments, the self-close mechanism may be activated with the first hinge part 3 extending at more than or less than 65°.

In the closed position, the first hinge part 3 extends at an angle "c" of around −5° to the second hinge part 5. In other embodiments, the closed position may correspond to an angle more than or less than −5°.

The soft-close mechanism 61 is arranged on the first hinge part 3 and co-operates with the hinge pin 7 on the second hinge part 5 to counteract the closing force of the over-close mechanism 57 and the self-close mechanism 59 as the hinge 1 moves towards the closed position so that final closing movement is braked.

In this embodiment the soft-close mechanism 61 comprises a damper member or pad 91 and a damper 93 arranged to bias the damper pad 91 to engage the hinge pin 7 in the open and closed positions and during movement between the open and closed positions.

The damper pad 91 is slidably mounted in a bore 95 in the pivot housing 45 that opens to the bore 49 in the sleeve 47 and the hinge pin 7 has a cam portion 97 aligned with the bore 95. The cam portion 97 has two cam faces 97*a*, 97*b* that are flat and extend at an angle to each other.

The damper pad 91 engages the cam face 97*a* in the open position. In this embodiment the cam faces 97*a*, 97*b* extend at approximately 125°. The angle between the cam faces 97*a*, 97*b* may be different in other embodiments.

The damper 93 has a cylinder 93*a* containing a damping fluid such as oil and a piston 93*b* extending from the cylinder 93*a* to engage the damper pad 91. The damping fluid acts to brake movement of the piston rod 93*b* into the cylinder 93*a*.

In other embodiments, the damper pad 91 may be configured to assist assembly in the correct orientation. FIG. 19 shows a modification in which the damper pad 91 is provided with one or more chamfers 91*a* to prevent the damper pad 91 being inserted in the bore in the wrong orientation.

The operation of the soft-close mechanism 61 will now be described in more detail with reference to FIGS. 12 to 15.

Figure 12:
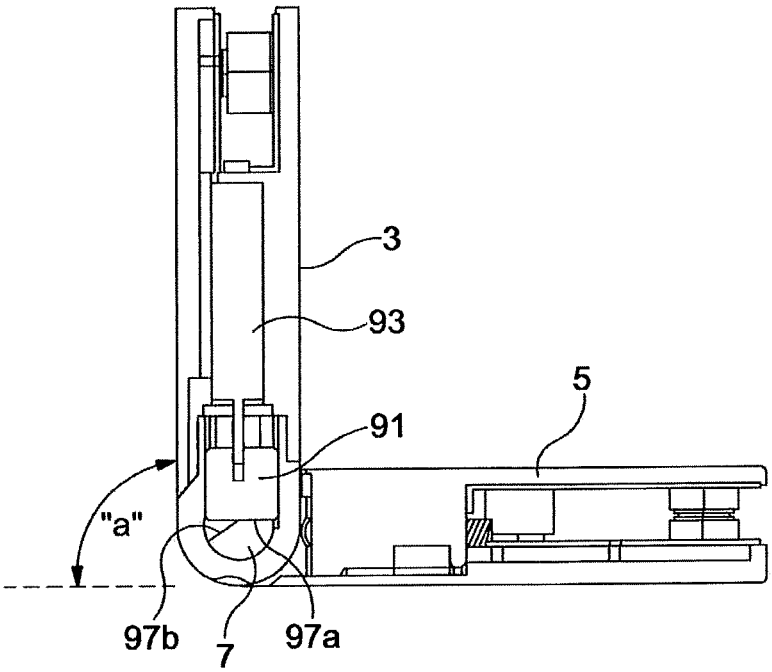
FIGS. 12, 13, 14 and 15 are schematic views showing operation of the soft-close mechanism of the hinge shown in FIG. 3.

FIG. 12 shows the hinge 1 in the open position with the first hinge part 3 extending at an angle "a" of around 90° to the second hinge part 5. In other embodiments, the open position may correspond to an angle more than or less than 90°.

In the open position the damper pad 91 engages the flat cam face 97*a* with the piston rod 93*b* extended. As the hinge part 3 rotates about the hinge axis towards the closed position, the damper pad 91 moves to engage the cam face 97*b* and pushes the piston rod 93*b* towards the cylinder 93*a* to activate the self-closing action to brake movement of the hinge 1 to the closed position.

As the hinge part 3 continues to rotate towards the closed position, the damper pad 91 moves to push the piston rod 93*b* further towards the cylinder increasing the braking force to counteract the closing force of the over-close mechanism 57 and the self-close mechanism 59 so that the closing speed is reduced as the hinge 1 approaches the closed position.

Figure 13:
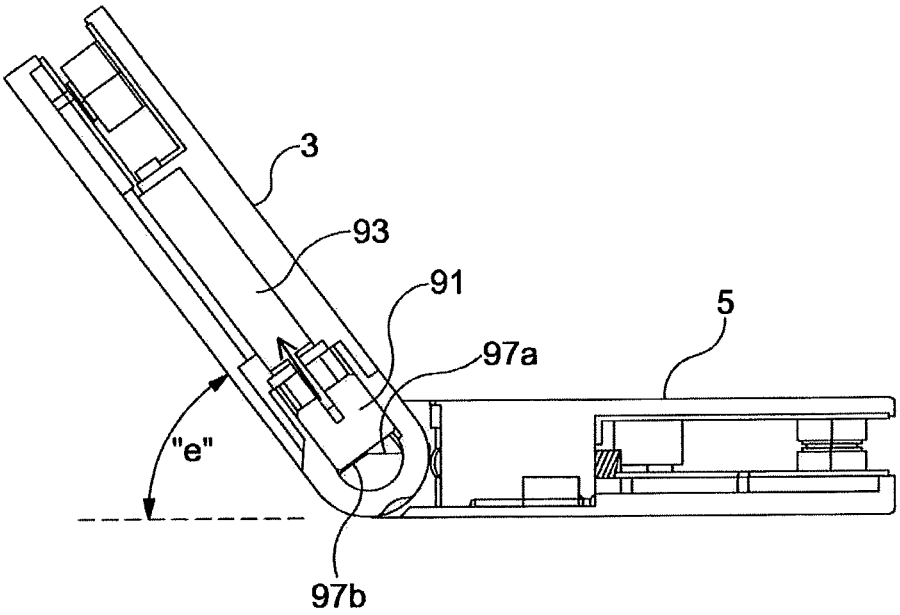
Figure 14:
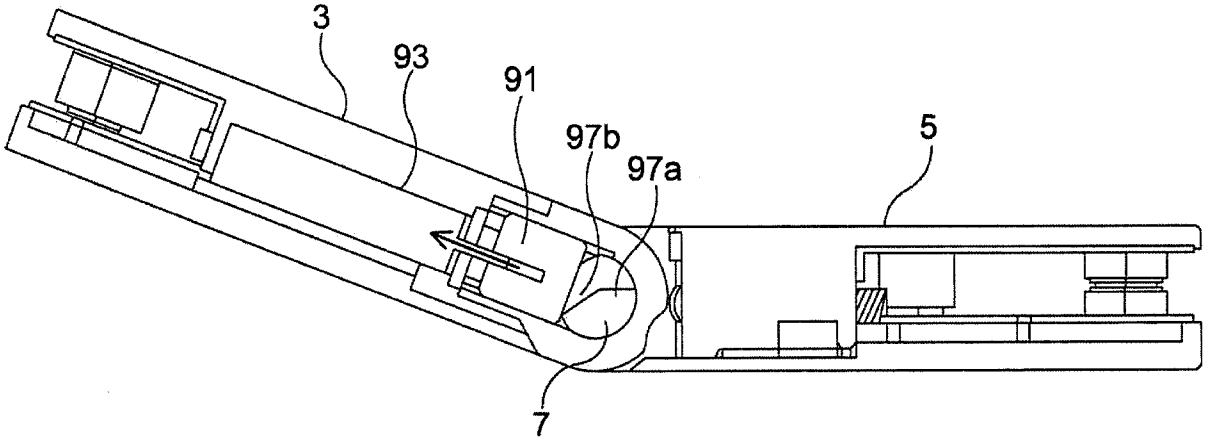
Figure 15:
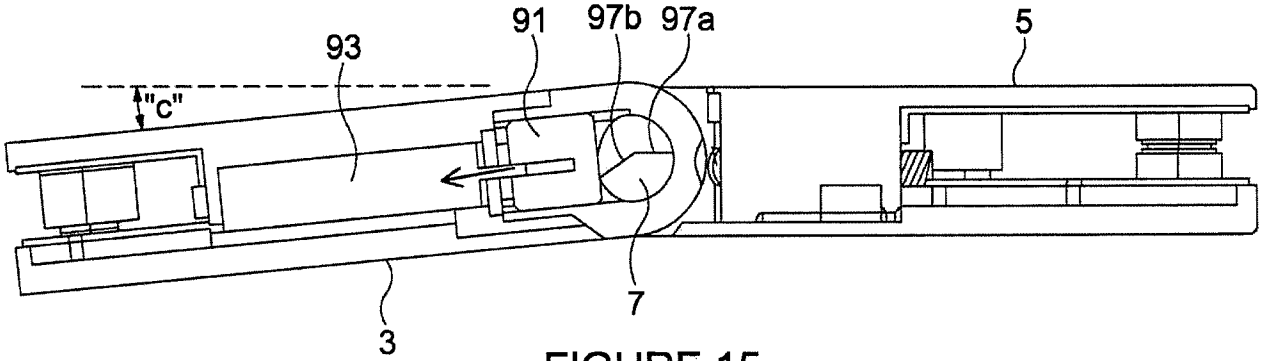

FIG. 13 shows the hinge 1 in an intermediate position at the start of the soft-closing action. FIG. 14 shows the hinge 1 in a further intermediate position and FIG. 15 shows the hinge 1 in the closed position.

In this embodiment, the soft-close mechanism 61 is activated with the first hinge part extending at an angle "e" of around 55° to the second hinge part 5. In other embodiments, the soft-close mechanism 61 may be activated with the first hinge part 3 extending at more than or less than 55°.

In general it may be preferred that the soft close mechanism 61 is activated after the self-close mechanism 59 and before the over-close mechanism 57.

In the closed position, the first hinge part 3 extends at an angle "c" of around −5° to the second hinge part 5. In other embodiments, the closed position may correspond to an angle more than or less than −5°.

Figure 16:
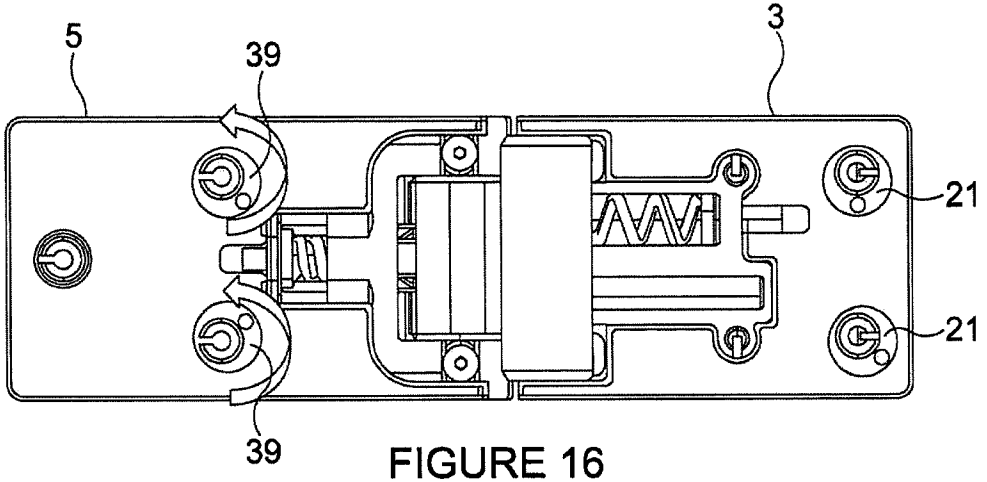
FIGS. 16 and 17 are sectional views of the hinge showing the operation of the height adjustment mechanism.
Figure 17:
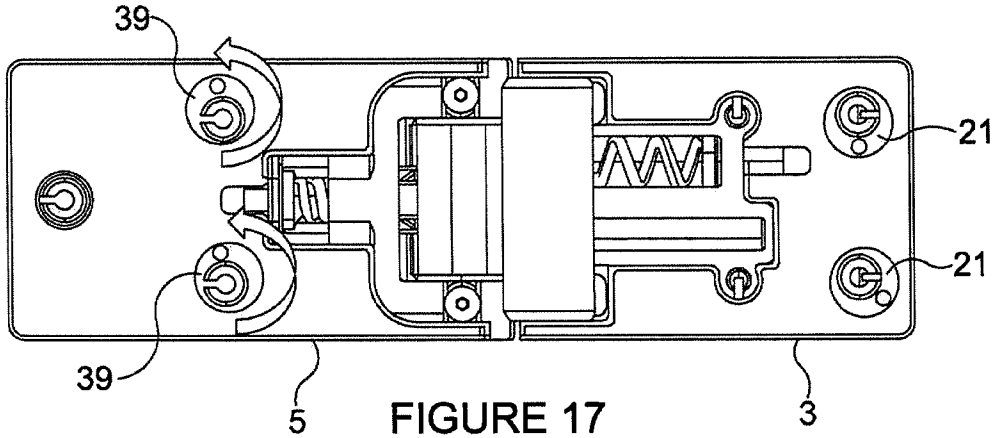

Referring now to FIGS. 16 and 17, rotation of the eccentric washers 39 of the second hinge part 5 to adjust the height of a door supported by the hinge 1 is shown. The eccentric washers 21 of the first hinge part 3 may be rotated in similar manner to adjust the height.

In the exemplary embodiment, the hinge has been described for mounting a shower door. It will be understood however that the hinge has wider application for mounting any movable panel. Also, in the exemplary embodiment, the hinge has been described to include the combination of over-close mechanism, self-close mechanism and soft close mechanism. It will be understood however that each of these mechanisms may be employed separately or in combination with one or both of the other mechanisms. It will also be understood that each of these mechanisms may be replaced by an alternative mechanism having a similar function and used in combination with one or both of the other mechanisms.

In another aspect, the invention provides a hinge for mounting a movable panel such as a shower door, the hinge comprising a first hinge part for securing to a movable panel and second hinge part for securing to a fixed structure, the second hinge part having a hinge pin to which the first hinge part is connected for movement relative to the second hinge part about a hinge axis between a closed position and an open position, and at least one of an over-close mechanism, a self-close mechanism and a soft-close mechanism.

In some embodiments the over-close mechanism is provided and is configured to be activated as the first hinge part approaches the closed position.

It may be that the over-close mechanism assists closing movement.

It may be that the over-close mechanism comprises a catch member on the second hinge part arranged to cooperate with the first hinge part to urge the first hinge part towards the closed position during closing movement of the first hinge part and to retain the first hinge part in the closed position.

It may be that the catch member is biased to engage the first hinge part.

It may be that the catch member is biased by a spring.

It may be that the biasing force is adjustable.

In some embodiments the self-close mechanism is provided and is configured to be activated during movement of the first hinge part from the open position to the closed position.

It may be that the self-close mechanism comprises a pressure member on the first hinge part arranged to cooperate with the hinge pin to urge the first hinge part towards the closed position during closing movement.

It may be that the pressure member is biased to engage the hinge pin.

It may be that the pressure member is biased by a spring.

It may be that the biasing force is adjustable.

It may be that the pressure member engages a cam portion of the hinge pin.

It may be that the cam portion has cam faces engaged by the pressure member to hold the first hinge part in the open and closed positions.

In some embodiments the soft-close mechanism is provided and is configured to be activated during movement of the first hinge part from the open position to the closed position.

It may be that the soft-close mechanism resists closing movement.

It may be that the soft-close mechanism comprises a damper member on the first hinge part arranged to cooperate with the hinge pin to provide a braking force in the direction of closing.

It may be that the damper member is biased to engage the hinge pin.

It may be that the damper member engages a cam portion of the hinge pin.

It may be that the damper member is biased by a damper.

It may be that the damper comprises a damping fluid responsive to displacement of the damper member by the hinge pin to apply a damping force to brake closing movement of the first hinge part.

In some embodiments both the over-close mechanism and self-close mechanism are provided, and the self-close mechanism is activated before the over-close mechanism in the direction of closing.

In some embodiments both the self-close mechanism and soft-close mechanism are provided, and the self-close mechanism is activated before the soft-close mechanism in the direction of closing.

In some embodiments both the soft-close mechanism and over-close mechanism are provided, and the soft-close mechanism is activated before the over-close mechanism in the direction of closing.

In some embodiments, the over-close mechanism, self-close mechanism and soft close mechanism are provided, and the self-close mechanism is activated before the soft-close mechanism which in turn is activated before the over-close mechanism in the direction of closing.

In another aspect the invention provides a hinge for mounting a movable panel such as a shower door, the hinge comprising a first hinge part for securing to a movable panel and second hinge part for securing to a fixed structure, the first hinge part being connected for movement relative to the second hinge part about a hinge axis between a closed position and an open position, wherein at least one of the first and second hinge parts has an adjustment mechanism for height adjustment of a movable panel mounted by the hinge.

It may be that the height adjustment mechanism comprises at least one eccentric washer that is rotatable to adjust the height of a movable panel mounted by the hinge.

In another aspect the invention provides a hinge as defined in claim 1. Optional features of the hinge are the subject of claims 2 to 23.

Other features benefits and advantages of the invention as well as modifications or changes within the scope of the invention will be apparent to those skilled in the art.

The invention claimed is:

1. A hinge comprising:

a first hinge part for securing to a movable panel of a shower door, the first hinge part having a pivot housing;

a second hinge part for securing to a fixed structure;

a hinge pin extending through a bore in the pivot housing and operatively coupled to the second hinge part to provide pivotal movement of the first hinge part relative to the second hinge part about a hinge axis, which is defined by the hinge pin, between a closed position and an open position;

an over-close mechanism comprising a housing, which is movably coupled to the second hinge part, and a roller supported by the housing and configured to engage the pivot housing a catch member on the second hinge part arranged to co operate with the first hinge part to urge the first hinge part towards the closed position during closing movement of the first hinge part and to retain the first hinge part in the closed position;

a self-close mechanism comprising a pressure pad movably coupled to the first hinge part and arranged to co-operate with the hinge pin to urge the first hinge part towards the closed position during closing movement; and a soft-close mechanism comprising a damper pad movably coupled to the first hinge part and arranged to co-operate with the hinge pin to provide a braking force in a direction of closing.

2. The hinge according to claim 1 wherein the pivot housing includes a groove configured to receive the roller.

3. The hinge according to claim 1 further comprising a biasing member configured to bias the housing and roller towards the pivot housing.

4. The hinge according to claim 3 wherein the biasing member produces a biasing force that is adjustable.

5. The hinge according to claim 1 further comprising a biasing member configured to bias the pressure pad towards the hinge pin.

6. The hinge according to claim 5 wherein a biasing force that biases the pressure pad is adjustable.

7. The hinge according to claim 1 wherein the pressure pad engages a cam portion of the hinge pin.

8. The hinge according to claim 7 wherein the cam portion has first and second cam faces engaged by the pressure pad to hold the first hinge part in the open and closed positions.

9. The hinge according to claim 7 wherein the cam portion includes a third cam face, which is engaged by the pressure pad during movement of the first hinge part between the open and closed positions.

10. The hinge according to claim 1 further comprising a damper configured to bias the damper pad towards a cam portion of the hinge pin.

11. The hinge according to claim 10 wherein the damper comprises a damping fluid responsive to displacement of the damper pad by the hinge pin to apply a damping force that breaks movement of the first hinge part in the direction of closing.

12. The hinge according to claim 1 wherein at least one of the first and second hinge parts has an adjustment mechanism for height adjustment of the movable panel mounted by the hinge, and wherein the height adjustment mechanism comprises at least one eccentric washer that is rotatable to adjust the height of the movable panel mounted by the hinge.

13. The hinge according to claim 3 wherein the biasing member comprises a spring.

14. The hinge according to claim 5 wherein the biasing member comprises a spring.

15. The hinge according to claim 6 further comprising an abutment member and a spring, wherein the spring acts on the pressure pad to provide the biasing force, and the abutment member is movable relative to the spring to adjust the biasing force provided by the spring.

16. The hinge according to claim 2 wherein the groove is configured to receive the roller when the first hinge part is in a range of 10° to −5° relative to the second hinge part, and wherein the first hinge part and second hinge part are parallel at 0°.

* * * * *